US005337455A

United States Patent [19]

Pinto et al.

[11] Patent Number: 5,337,455

[45] Date of Patent: Aug. 16, 1994

[54] DEVICE AND METHOD FOR PNEUMATICALLY FEEDING A FEEDING CHUTE

[75] Inventors: Akiva Pinto, Duesseldorf-Wittlaer; Guenter Lucassen, Haltern; Ulrich Schmidt-Doepper, Luedinghausen; Ulrich Hartmann, Duelmen; Winfried Heuermann, Gescher, all of Fed. Rep. of Germany

[73] Assignee: Hergeth Hollingsworth GmbH, Duelmen, Fed. Rep. of Germany

[21] Appl. No.: 30,434

[22] PCT Filed: Feb. 14, 1990

[86] PCT No.: PCT/EP90/00234

§ 371 Date: Aug. 29, 1991

§ 102(e) Date: Aug. 29, 1991

[87] PCT Pub. No.: WO90/09471

PCT Pub. Date: Aug. 23, 1990

[30] Foreign Application Priority Data

Feb. 17, 1989 [DE] Fed. Rep. of Germany ..... 3904853
Feb. 17, 1989 [DE] Fed. Rep. of Germany ..... 3904878

[51] Int. Cl.[5] ..... D01G 23/02
[52] U.S. Cl. ..... 19/105
[58] Field of Search ..... 406/70, 85, 168, 171; 55/417; 19/105

[56] References Cited

U.S. PATENT DOCUMENTS

| | | | |
|---|---|---|---|
| 560,914 | 5/1896 | Murray | 406/171 |
| 3,400,518 | 9/1968 | Staheli | 406/171 |
| 3,708,210 | 1/1973 | Stähel et al. | 406/70 |
| 4,240,180 | 12/1980 | Wood et al. | 19/105 |
| 4,280,251 | 7/1981 | Ludwig | 406/70 X |
| 4,305,740 | 12/1981 | Revell | 406/168 X |
| 4,394,790 | 7/1983 | Keller et al. | 19/105 |
| 4,520,531 | 6/1985 | Hergeth | 19/105 |
| 4,878,784 | 11/1989 | Binder et al. | 406/70 |
| 4,939,815 | 7/1990 | Leifeld | 19/105 |
| 5,005,261 | 4/1991 | Pinto et al. | 19/105 |

FOREIGN PATENT DOCUMENTS 2939968 4/1981 Fed. Rep. of Germany .

*Primary Examiner*—Clifford D. Crowder
*Assistant Examiner*—John J. Calvert
*Attorney, Agent, or Firm*—Ralph Bailey

[57] ABSTRACT

A device is provided for feeding fiber material into a textile machine, comprising a horizontal transport channel (10), a feeding chute (2) branching vertically downward from the transport channel (10), an air-collecting chamber (3) separated by an air-permeable intermediate wall (9) from the feeding chute (2) connected with the transport channel (10), the air collecting chamber (3) being provided with a closable blow-off opening for discharging the flow of transport air, and a fiber transport device (18) at the lower end of the feeding chute (2), wherein at least one blow-off opening (6) is arranged at the lower end of the air-collecting chamber, alternately suddenly blowing off or shutting off the flow of transport air (7).

18 Claims, 5 Drawing Sheets

DEVICE AND METHOD FOR PNEUMATICALLY FEEDING A FEEDING CHUTE

BACKGROUND OF THE INVENTION

This invention relates to a device for pneumatically supplying fiber flocks, e.g. cotton, synthetic fiber material, etc. to a chute or the like, wherein via a feed conduit, the fiber material is conveyed by means of transport air, comprising an air collecting chamber separated by an air-permeable vertical intermediate wall from the feeding chute connected with the transport channel, the air-collecting chamber being provided with a closable blow-off opening for discharging the flow of transport air, and a method for feeding fibers into textile machines by deflecting a mixture of fibers and transport air into a feeding chute, separating the transport air from the fiber material in a feeding chute equipped with an air-permeable intermediate wall, blowing off the transport air from an air collecting chamber arranged behind the air-permeable intermediate wall, and supplying the fiber material from the lower end of the feeding chute.

Such devices are used, for example, for carding machines in order to supply a rather uniform compacted mat of material to the machines. In doing so, the fibers are conveyed in pipelines in a mixture of fiber material and transport air and filled into the feeding chutes associated with the textile machines by deflecting the flow of transport air.

In supplying fiber material to a chute, it is important that the fiber material is uniformly distributed over the width of the chute when it is discharged from the pneumatic feed line and that the fiber material in the feeding chute is uniformly piled over the width and depth thereof. In general, transport air of the pneumatic feed is discharged at one wall surface of the feeding chute. To this effect, one longitudinal wall of the feeding chute is either permeable or it contains corresponding apertures. However, it may happen that fiber material more or less adheres to the air-permeable wall through which transport air shall get out, so that the release of the transport air is impaired with a resultant disadvantageous effect for the filling density of the feed chute. The way in which the dropped fiber flocks are distributed in the feeding chute is merely accidental. If the fiber material caught by the perforated wall of the feeding chute and having a more or less long residence time at the screen surface during the evacuation of transport air exceeds a specific weight of mass, it drops by overweight from the screen surface. However, such events are irregular and beyond control. The piling of fibers in the chute is substantially accidental.

According to German Patent 33 15 909, it has been known for a device, producing a mat of fiber flocks comprising a substantially vertical chute of a continuous rectangular cross section in the upper part of which ends a feed line for fiber flocks, while the lower chute end includes a means extending over its width for extracting the fibers as a mat, that a plurality of scanning points distributed over the width of the fiber mat is provided for detecting the mat density. Said measuring points are connected via a control means and a corresponding number of elements provided at various points of the chute for changing the air flow prevailing at said points in the chute. The measuring points may be pedal troughs. Such an arrangement is very involved. Air flow is influenced subsequently, i.e. after the mat has left the feed means over a considerable path length.

In a known feeding device for fiber material (European Patent 0 176 668), a feeding chute is disposed below the pipeline, which is separated from an air-collecting chamber by an air-permeable intermediate wall. The air-permeable wall has its upper end provided with an opening through which the transport air, separated from the fiber material at the intermediate wall, may be supplied to a waste air line. The section of the passage of the opening can be varied by means of a pivotable flap. A pair of rolls is arranged at the end of the feeding chute for feeding the fiber material from the feeding chute to the successive machine.

In doing so, the opening at the upper end of the air-collecting chamber, which is variable in the degree of opening and which can also be shut off, serves for regulating the supply of fiber material from the pipe to the feeding chute by the rate of the transport air discharged. In the extreme case, i.e. with the opening shut, no fiber material can fall into the feeding chute, at least in theory, since the flow of transport air is not deflected into the feeding chute because of the pressure-tight closure of the air-collecting chamber and the feeding chute. In such a feeding chute arrangement, there is no vibration of the fiber material contained in the feeding chute, so that there is no levelling of the height of the stack of fiber material over the width of the feeding chute, and, therefore, the weight load and the unit pressure on the lowest fiber layer in the feeding chute differ, which results in a non-uniformly compacted fiber mat being supplied to the successive machine.

It is the object of the invention to provide a device of the initially mentioned type wherein a maximum levelling of the fiber material over the width of the device is achieved.

It is a further object of the invention to design and configure a feeding chute having a permeable wall surface for discharging transport air in such a way that, without a positively operating control means, the fiber material is piled directly in a substantially uniform density over the width of the chute.

SUMMARY OF THE INVENTION

This invention substantially relates to a random opening and closing control upon the discharge of the transport air from the air-collecting chamber without a control program being effective directly or indirectly. It has been found that an optional change of opening and closing operating for the discharge of the transport air allows to automatically adjust normal air conditions in the feeding or filling chute. Probable troubles during the piling of the fiber material in the chute are eliminated automatically by the opening and closing control of the transport air during its exit out of the air-collecting chamber, subject to the speed at which the change of closing and opening is performed during the exit of the transport air. Thus, the inventive idea is realized in the random opening and closing of the shut-off member concerned. In this way, the passage openings to the closed air-collecting chamber, from which the transport air is discharged, are kept free, so that the cross section of the feeding chute is kept free from obstructions and the like caused by the fiber stock. Thus, a distribution of the fed fiber stock over the width of the chute may be obtained together with an effective unification of the fiber density within the chute. Control devices that are necessary only in case of an irregular piling and distribution of the fiber material in the feeding chute, are not needed at all.

Due to such a configuration of the chute, a distribution of the fed fiber material over the chute width and an effective unification of the fiber density may be achieved in the chute. In fact, the distribution of the fiber material over the chute width is equalized at least roughly and directly in the chute itself. It is not necessary to provide a special control means responsive to measuring points at the mat. The air flow effect is not only used for equalizing the piling of the fiber flocks over the width of the chute, but one also benefits directly therefrom for compacting purposes without additional control means. After all, an opening and closing control is used with the discharge of the transport air from the air-collecting chamber without the need of including a program.

According to another feature of the invention, the housing forming the closed collecting chamber may be subdivided by a vertical wall or the like, the housing parts being provided with a transport air discharge containing a closing member. Preferably, the closing members at the two housing parts may be opened and closed alternatively, thus obtaining a certain pumping effect only by the leaping distribution of air flows in the chute.

Due to another embodiment of the invention, the housing forming the closed air-collecting chamber may be divided by vertical walls to obtain a predetermined number of housing parts, each housing part being provided with a discharge containing the closing member. Again, a determined time control need not be provided for the closing member, but it will do that the change of closing and opening is realized without a program over the width of the chute.

If transport air is prevented from being discharged in a housing section, the fiber material caught at the wall drops therefrom downwardly, so that normal air conditions may prevail again. Irregularity of opening and closing control of the closing members is accompanied by the unexpected result that the fiber material may be piled uniformly without any troubles over the width and depth of the chute, with a resultant substantially uniform density of the fiber material in the feeding or filling chute.

In the embodiment of FIGS. 5 to 7, the fiber flocks in the feeding chute are compacted to a high degree in the upper area of the feeding chute by the flow of transport air flowing through them and, in combination with a pulsing vibration in the feeding chute, they are levelled over the width of the device with respect to their filling level such that a fiber mat supplied to the successive machine at the lower outlet of the feeding chute has a high uniformity with respect to the fiber density over its entire width and length. Alternately shutting and opening the blow-off opening in the air-collecting chamber causes a pulsation that also prevents a sticking of the fibers to the air-permeable intermediate wall and, thus, a clogging of the intermediate wall. In the shut-off phase, the air flowing into the air-collecting chamber is hindered abruptly in escaping via the blow-off opening, so that a stagnating pressure occurs in the air-collecting chamber that is also effective in the feeding chute via the intermediate wall. The compacting effect in the upper part of the feeding chute, closed on all sides, is intermittently interrupted by the stopped flow of transport air, whereby, supported by the stagnating pressure in the air-collecting chamber and the feeding chute, the stack of fiber flocks in the feeding chute is momentarily lifted. In this way, a compression and a pulsing vibration are generated alternately, causing a levelling of the stack of fiber material over the entire width of the device.

It is an essential advantage of the device according to the present invention that it is of a simple construction that can be produced at low cost, further providing a low probability of failure.

It may be provided to divide the air-collecting chamber vertically and orthogonally to the feeding chute into two chambers by at least one air-impermeable separating wall and to provide at least one closable blow-off opening for each chamber at the lower ends thereof.

Dividing the air-collecting chamber into chambers has, for example, the advantage that upon a shut-off of the respective blow-off openings no instantaneous pressure compensation can occur over the entire width of the air-collecting chamber and the feeding chute, whereby the pulsing vibration is increased.

It is provided in one embodiment to arrange the blow-off openings laterally at the chambers. Without great constructional effort, the lateral arrangement of the blow-off opening permits the connection of suction channels with which the transport air may be supplied, for example, to the suction means of a carding machine.

It may also be provided to arrange the blow-off openings in the bottom of the chambers. Arranging the blow-off openings in the bottom of the air-collecting chamber, in turn divided into chambers, has the advantage that the flow of transport air is not interrupted before the lower end of the feeding chute.

Preferably, it is contemplated that a control means controls the alternating shut-off and opened phases of the blow-off openings in an overlapping manner. As an effect of the overlapping control, no flow of transport air is blown from the chambers of the air-collecting chamber at all for a short time, whereby an increased stagnating pressure and, thus, a stronger pumping effect are generated.

The intermediate wall may consist of a meshed screen. Due to the strong pumping effect from the air-collecting chamber, the fibers advantageously do not get hooked in the intermediate wall, even if a meshed screen is used as the intermediate wall.

It is provided in an embodiment that the wall of the feeding chute opposite the air-permeable intermediate wall is elastically supported and movable in the horizontal direction transversal to the feeding chute. Thereby, the pumping effect can be additionally increased in combination with overlapping shut-off phases of adjacent blow-off openings, the wall of the feeding chute causing a mechanical vibration of the fiber material contained in the feeding chute.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
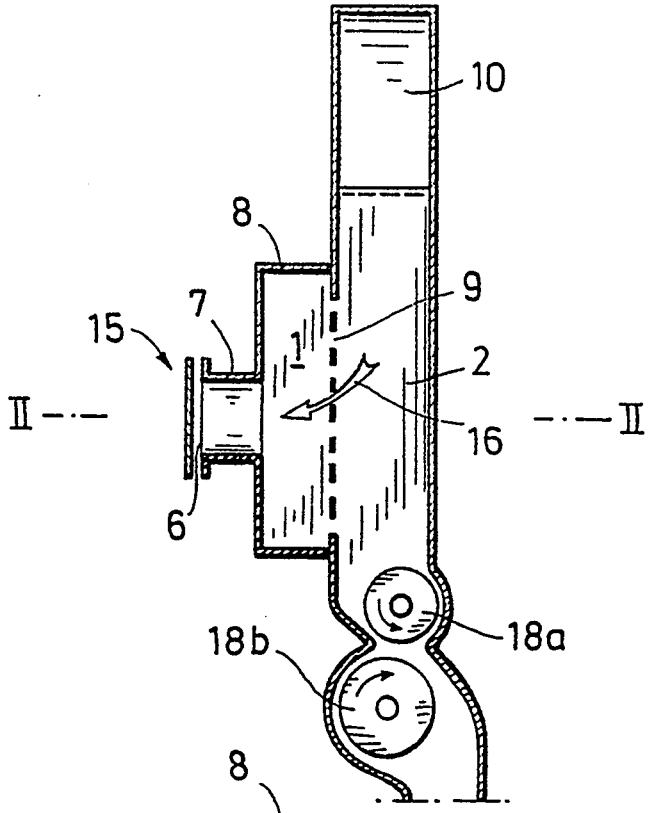
FIG. 1 is a schematic view of a feeding or filling chute constructed according to the invention.
Figure 2:
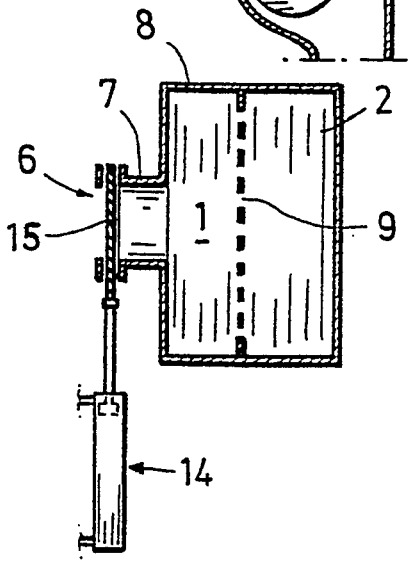
FIG. 2 is a cross section along line II—II in FIG. 1.

As evident from the embodiment of FIGS. 1 and 2, due to a transport channel 10 above the feeding or filling chute 2, the fibre material is conveyed pneumatically into chute 2, at the lower end of which take-off rollers 18*a* and 18*b* may be set up. For the escape of the transport air by which fiber material is supplied to chute 2, one wall of the latter is totally or partly provided with a permeable intermediate wall 9 which is perforated or otherwise adapted to be air-permeable. Within the area of the permeable intermediate wall 9, a housing 8 is preset which serves as an air-collecting chamber 1 for the transport air to be discharged. The housing 8 includes a piece 7 with a blow-off opening 6 for the exit and discharge of the transport air, said blow-off opening 6 being provided with a closing member 15 that may consist of a slide, a valve, a flap or the like. The drawing shows a slide 13 adapted to be reciprocated by a piston cylinder unit 14 so that, in case of an advanced slide, the blow-off opening 6 is closed, while, with the slide 11 in withdrawn position, the blow-off opening 6 is open.

By a constant opening and closing movement of the closing member 15 at the blow-off opening 6 of the transport air, air flow in chute 2 may be effectively influenced. In case of an opened closing member 15, air 16 flows through the permeable intermediate wall 9 into the collecting chamber 8 and out of the blow-off opening 6. As a result, fiber flocks may be induced to more or less adhere to the permeable intermediate wall 9 until the fiber accumulation has grown to an extend at which it drops by its own weight. A uniform depositing of the fed fiber material in chute 2, as well as a uniform distribution over the width of the chute and the density of the fiber column will be considerably affected this way. If the closing member 15 locks blow-off opening 6, the fiber material does not tend any longer to adhere to the permeable intermediate wall and will be piled up uniformly in chute 2 by means of the transport air flow. This is applicable to a natural discharge of transport air, but also to an air discharge supported by suction or the like. A steady opening and closing of blow-off opening 6 will cause a pulsating effect of the flow of the transport air in the chute. From the beginning, interfering influences during the uniform distribution and setting of fiber flocks in the chute are excluded. A natural uniformity of distribution of fibre flocks in the chute is obtained.

Figure 3:
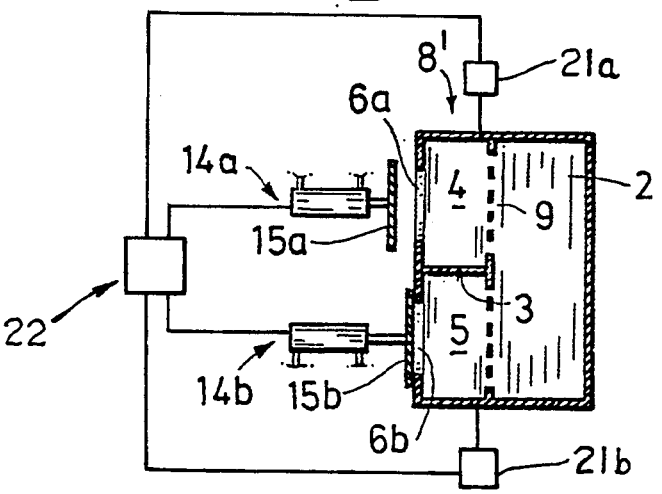
FIG. 3 is a cross section of a filling chute in a modified embodiment, schematically illustrated.

In case of the embodiment of FIG. 3, the housing 8' prefixed at the intermediate wall 9 is subdivided by a partition wall 17 so that a separate blow-off opening 6*a* or 6*b* is assigned to each closed housing portion with chambers 4 and 5, said blow-off openings 6*a* and 6*b* for the transport air being provided with separate closing members 15*a* or 15*b*, to each of which an independent driving means 14*a* or 14*b* is assigned. Also in said arrangement, the closing members 15*a* and 15*b* may be operated by a control means 22 at an irregular cycle. Troubles normally existing in the chute during the evacuation of the transport air are avoided. Preferably, the closing members at chambers 4 and 5 are adapted to be closed and opened alternatively to obtain a certain pumping effect with the air flow to be discharged. Within the area of the chute in which the discharge of transport air is stopped, the air flow has a compacting effect on the fiber material column, said effect changing from one area to the other, thus ensuring automatically a uniform pulling and compacting effect of the fiber material in the chute.

Figure 4:
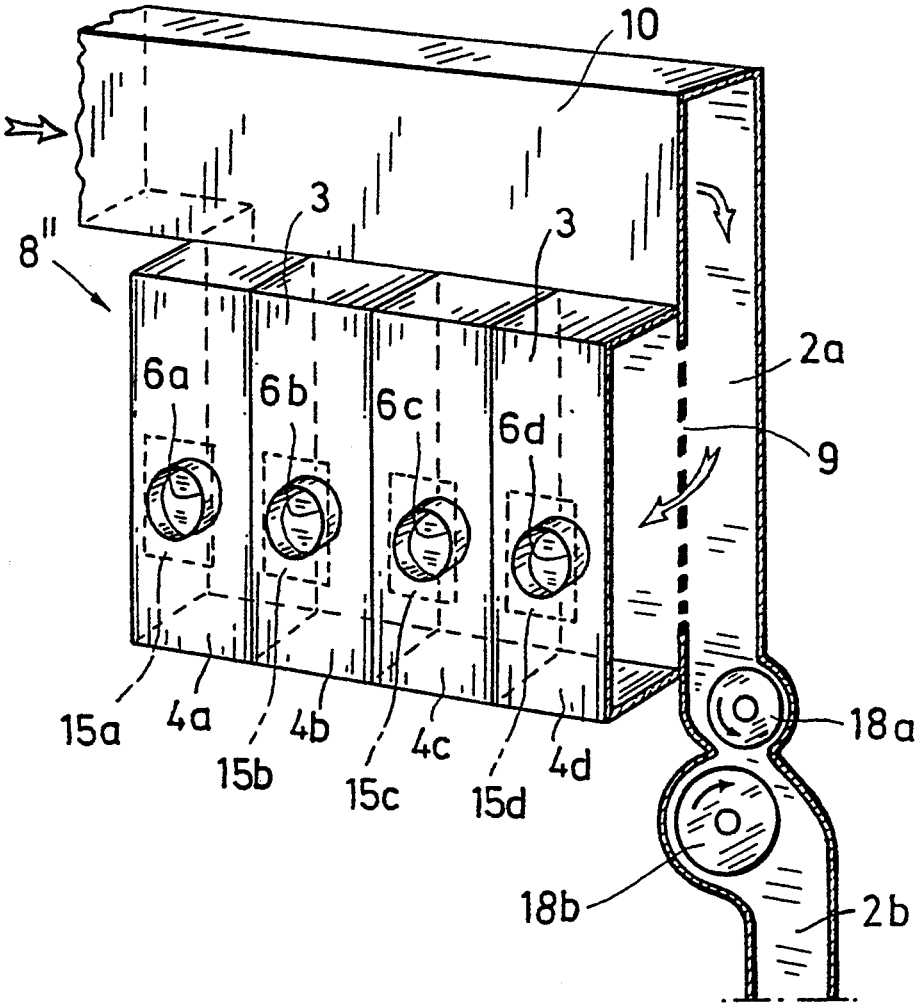
FIG. 4 is a further embodiment of the feeding or filling chute with a plurality of subdivisions of the housing provided in the chute.

In case of the embodiment of FIG. 4, the chute is subdivided into an upper section 2*a* and a lower section 2*b*, the measure of the invention being provided for the upper section 2*a*. Housing 8" preceding the permeable intermediate wall 9 of the upper section 2*a*, is for instance subdivided into four housing parts 8*a*, 8*b*, 8*c*, 8*d* with chambers 4*a*–4*d*, each part being provided with a separate blow-off opening 6*a*, 6*b*, 6*c*, 6*d* for the transport air, of which each blow-off opening includes an automatically movable closing member 15*a*, 15*b*, 15*c*, 15*d*, for instance in the form of slides and, as shown in FIGS. 1 to 3, contains independent driving means. The closing member may be a flap adapted to move vertically to the exit surface of the discharge for the transport air. Use may be made as well of simple valve means. The different closing members may be moved in total or partly on and off independently of each other. It is also possible to maintain a specific sequence so that the closing members are moved on and off in consecutive order or with an optional change. A constant change of flow direction of the transport air in the feeding chute is caused this way, so that the desired uniformity of the pile of fiber flocks in the feeding chute is supported accordingly. Measuring devices over the width of the discharged mat for testing its quality are unnecessary. The front side of the housing or housing parts may be transparent, thus allowing to observe by view the operation of the closing members. The size of the housing parts is dictated by the width of the filling chute. As a matter of fact, the housing may be arranged at the lower chute portion rather than at the upper portion thereof, or, if necessary, not only at the upper but also the lower chute portion.

Figure 5:
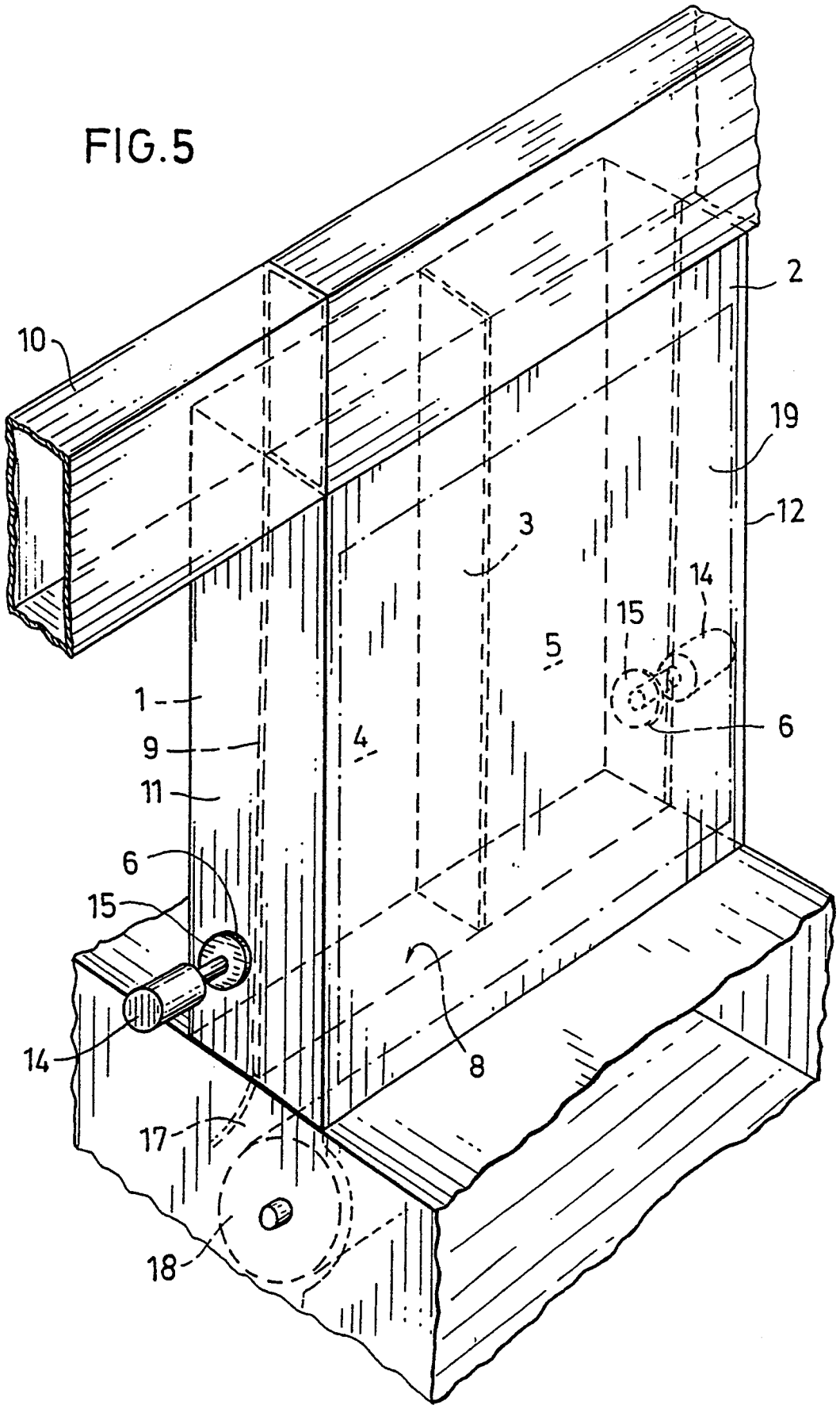
FIG. 5 is a perspective view of a further embodiment.

The device for feeding fiber material into a textile machine, as illustrated in FIG. 5, has a horizontally extending transport channel 10, through which fiber material, included in a mixture of fibers and transport air, is transported to a plurality of feed devices. A feeding chute 2 into which at least a part of the mixture of fibers and transport air is directed, thereby filling the feeding chute 2 with fiber material, branches vertically downward from the transport channel 10.

In the embodiment of FIG. 5, the transport channel 10 has a rectangular sectional shape. However, other sectional shapes of the transport channel are usable in combination with the present feed device.

The feeding chute 2 is separated from an air-collecting chamber 1, extending substantially over the entire width and height of the feeding chute 2, by an air-permeable intermediate wall 9, preferably of meshed wire. The upper and/or the lower end of the intermediate wall may have an air-impermeable portion.

By virtue of the air-permeable intermediate wall 9, the mixture of fibers and transport air is separated after the fibers have been compacted in the upper portion of the feeding chute 2, the flow of transport air reaching the air-collecting chamber 1 via the intermediate wall 9.

The air-collecting chamber 1 may be separated by an air-impermeable separating wall 3 or, deviating from the illustration in FIG. 5, it may also be divided several times vertically and transversally to the intermediate wall 9. The flow of transport air separated from the fibers, thus flows, as illustrated in the Figures, into two separated chambers 4, 5 of the air-collecting chamber 1. In FIG. 5, the separating wall is arranged in the center between the side walls 11, 12, another division of the air-collecting chamber 1 also being possible, e.g. in a ratio of $\frac{1}{3}$ to $\frac{2}{3}$, in order to balance, for example, the distribution of air into the two chambers 4, 5 due to the flow conditions.

In the lower portion of the air-collecting chamber 1, a blow-off opening 6 is provided in the respective side walls 11, 12 of the chambers 4, 5 that may be suddenly shut and opened. The embodiment is provided with an activatable piston-cylinder unit 14 that can suddenly open or close the blow-off openings by means of a lid-like closing member 15. It is essential in this regard that a sudden pressure relief is caused in the chambers 4, 5 by opening the blow-off openings and that there is a rapid pressure build-up upon closing the blow-off openings 6. By virtue of suitable means, the blow-off openings 6 are opened and shut almost without inertia. The cross sectional shapes of the blow-off openings are not limited to circular openings as shown in the embodiment of the FIGS. 5 to 7.

Figure 6:
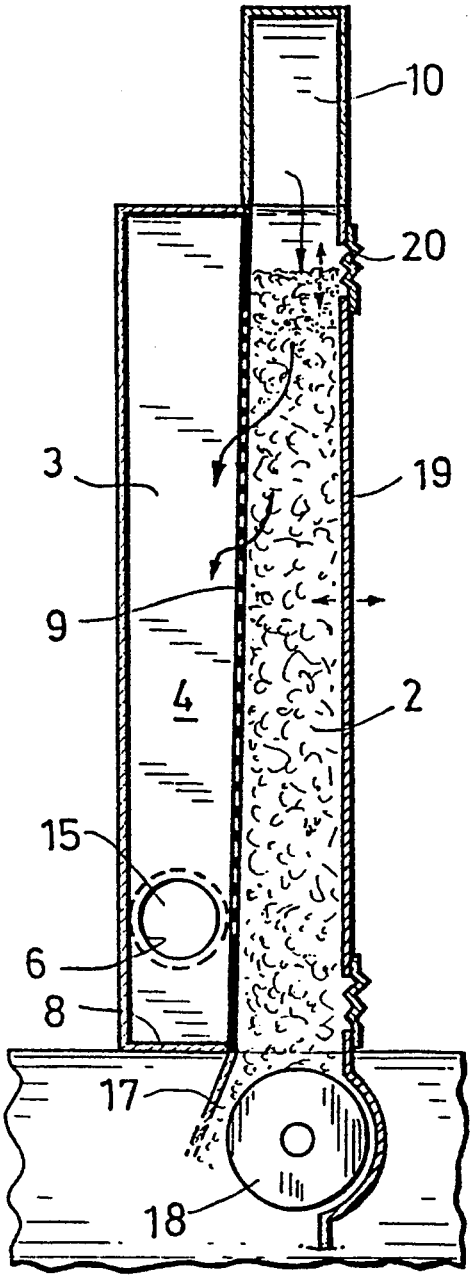
FIG. 6 is a cross section of the feeding device of FIG. 5.
Figure 7:
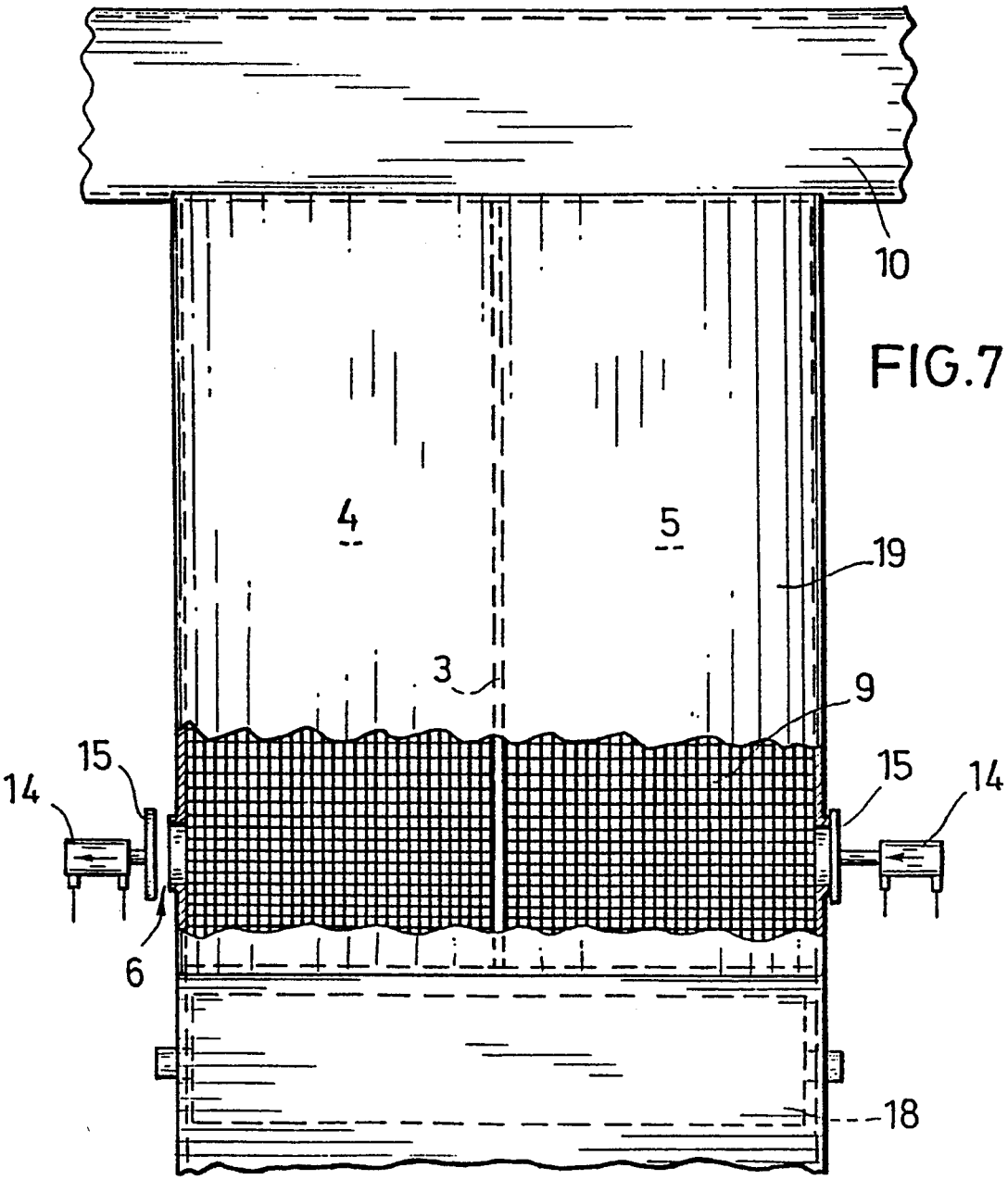
FIG. 7 is a view of the feeding device of FIG. 5 with the rear wall partly cut away.

Deviating from FIGS. 5 to 7, the blow-off openings 6 can be provided in the bottom 8 of the chambers 4, 5 preferably near the intermediate wall 9, in order to largely avoid a deflection of the flow of transport air when opening or closing the blow-off openings 6.

The lower portion of the intermediate wall 9 may have an air-impermeable strip in order to prevent the flow of transport air penetrating into the feeding chute 2 from being relieved at once via the lower opening of the feeding chute 2. Correspondingly, the blow-off openings 6, when arranged in the side walls, may be arranged on the level of the lower end of the air-permeable section of the intermediate wall 9.

A further possibility is to reduce the air-collecting chamber 1 and, correspondingly, the air-permeable intermediate wall 9 relative to the height of the feeding chute, so that a portion of the feeding chute protrudes upward and downward beyond the air-collecting chamber 1 at the upper and/or the lower end.

A feed gap 17, tapered in a funnel-like manner, is provided at the lower end of the feeding chute 2, which compacts the fiber material once more prior to its being supplied to the successive machine. The supply to the successive machine can be effected directly from the feeding chute 2. The successive machine may be, for example, an opening/cleaning machine or, due to the high degree of uniformity of the discharged fiber web, a carding machine or a further feed shaft. FIGS. 5 to 7 illustrate a transport device in the form of a doffer roller 18 that causes an additional compacting of the discharged supply web together with the funnel-shaped feed gap.

The blow-off openings 6 are alternately opened and shut for periods of from 2 to 5 seconds in the respective chambers 4, 5, the piston-cylinder units 14 being controlled such that both blow-off openings 6 are temporarily closed for a period of less than 1 second. Upon closing the blow-off openings 6 in the respective chambers, the downward directed flow of transport air is no longer discharged through the blow-off openings, whereby a stagnating pressure occurs in the lower part of the air-collecting chamber and the feeding chute. The stack of fiber material contained in the feeding chute 2 is relieved because of the lacking compression by the flow of transport air and is raised temporarily with support of the stagnating pressure, whereby the fibers in the feeding chute 2 are vibrated rhythmically according to the shut-off and blow-off phases.

Since the closing controls for the blow-off openings 6 overlap at least partly with regard to the shut-off phase, whereby a stagnating pressure is created in both chambers 4 and 5, the rear wall 19 of the feeding chute 2 that is in parallel to the intermediate wall 9 pulses in a horizontal direction according to the pressure build-up in the chambers 4 and 5 and in the feeding chute 2, so that an additional mechanical vibratory effect is generated by the vibrations of the rear wall.

In order to increase these vibrations of the rear wall 19 and to thereby increase the vibratory effect thereof, the wall may be supported in the frame of the feeding device by suited elastic means 20.

By means of the pneumatic and mechanic vibration, the density of the material is levelled and compacted in the best possible way over the width of the feeding chute 2. The density of the discharged fiber web can be varied by means of the control for the opening and shut-off periods of the blow-off openings by varying the frequency of the vibration of a corresponding control of the closing mechanisms. In doing so, one may also vary the overlapping phases.

The pulsation in the air-collecting chamber and in the feeding chute has a self-cleaning effect for the intermediate wall 9, so that a meshed screen may be used as the intermediate wall.

Due to the pumping effect, a meshed screen may be used as the intermediate wall 9, since the fibers cannot clog the meshed screen.

The control of the closing device for the blow-off openings 6 may also be performed with the help of sensors 21*a* and 21*b*. For example, the shut-off phase for the blow-off opening of a chamber could be initiated upon the occurrence of a certain flow speed in the chambers 4, 5, and the opened phase could be initiated upon reaching a certain dynamic pressure or upon detecting that the dynamic pressure has exceeded its maximum.

While a preferred embodiment of the invention has been described using specific terms, such description is for illustrative purposes only, and it is to be understood that changes and variations may be made without departing from the spirit or scope of the following claims.

What is claimed is:

1. A device for pneumatically feeding fiber flocks, to a feeding chute, wherein, via a transport channel, the fiber material is conveyed by means of a flow of transport air comprising:

an air-collecting chamber, an air-permeable vertical intermediate wall separating said air-collecting chamber from said feeding chute and from said transport channel, said air-collecting chamber having a closable blow-off opening for discharging the flow of transport air, and means constantly opening and closing the blow-off opening during the feeding operation creating a pulsing action of the flow of transport air in the feeding chutes whereby a more nearly uniform distribution of fiber flocks is achieved.

2. The structure set forth in claim 1, including a housing subdivided into a plurality of said chambers by a vertical partitioning wall, each having a blow-off opening containing a closing member.

3. The structure set forth in claim 2 wherein the blow-off openings are opened and closed alternately.

4. The structure set forth in claim 1 including a housing forming the closed air-collecting chamber subdivided by vertical walls to obtain a predetermined number of chambers and wherein each chamber is provided with a blow-off opening containing a closing member for the flow of transport air.

5. The structure set forth in claim 4 wherein said means constantly opens and closes the blow-off opening at a predetermined cycle.

6. A device for pneumatically feeding fiber flocks, to a feeding chute, wherein, via a transport channel, the fiber material is conveyed by means of a flow of transport air, comprising:

an air-collecting chamber separated by an air-permeable vertical intermediate wall from the feeding chute connected with the transport channel;

said air-collecting chamber being provided with at least one closeable blow-off opening for discharging the flow of transport air;

at least one blow-off opening arranged at a lower end of the air-collecting chamber, alternately suddenly blowing off or shutting off the flow of transport air;

means constantly opening and closing the blow-off opening creating a pulsing action of the flow of transport air in the feeding chute, and means for setting the filling level of the fibers for normal operation to a height that is higher than the upper edge of the air-permeable portion of the intermediate wall;

whereby a more nearly uniform distribution of fiber flocks is achieved.

7. The structure set forth in claim 6, wherein the air-collecting chamber is divided into chambers vertically and orthogonally with respect to the feeding chute by at least one air-impermeable separating wall, and each chamber has at least one closable blow-off opening arranged at the lower end of the chambers.

8. The structure set forth in claim 6 wherein said blow-off openings are arranged in the bottom of said air-collecting chambers that extends on the level of a lower end of said feeding chute.

9. The structure set forth in claim 6, wherein a control controls the alternating shut-off and blow-off phases of said blow-off openings in an overlapping manner such that all said blow-off openings are closed at the same time during an short overlapping phase.

10. The structure set forth in claim 6, wherein the wall of said feeding chute facing said air-permeable intermediate wall is supported elastically and is movable transversal to said feeding chute in a horizontal direction.

11. The structure set forth in claim 6, wherein said intermediate wall has an end provided with an air-impermeable portion extending over the entire width of said feeding chute.

12. The structure set forth in claim 6, wherein said feeding chute projects beyond said air-collecting chamber at at least one end.

13. A method for feeding fibers into textile machines comprising the steps of:

directing a mixture of fibers and transport air into a feeding chute;

separating a flow of transport air from the fiber material in a feeding chute equipped with an air-permeable intermediate wall;

supplying the fiber material from the lower end of the feeding chute;

compacting the fiber material contained in an upper portion of the feeding chute closed on all sides, by means of said flow of transport air;

constantly blowing off and shutting off the flow of transport air at the lower end of the air-collecting chamber creating a pulsing action of the flow of transport air in the feeding chute; and alternately vibrating the fiber material contained in the feeding chute during the blow-off and shut-off phases.

14. The method set forth in claim 13 wherein said flow of transport air is alternately blown off or shut off at at least two spaced locations.

15. The method set forth in claim 14 wherein the periods for the alternating shut-off and blow-off actions last between 2 and 5 seconds.

16. The method set forth in claim 14 wherein the step of timing the overlapping time of the shut-off phases of said adjacent chambers comprises setting the time periods for less than 1 second.

17. The method set forth in claim 14 comprising the step of shutting off the flow of transport air upon reaching a predetermined flow velocity of the transport air to be discharged.

18. The method set forth in claim 14 comprising the step of blowing off the flow of transport air when a maximum value of dynamic pressure is exceeded after the shut-off.

* * * * *